US005813759A

United States Patent [19]

Gebrian

[11] Patent Number: 5,813,759

[45] Date of Patent: Sep. 29, 1998

[54] METHOD AND APPARATUS FOR VORTEX MIXING USING CENTRIFUGAL FORCE

[75] Inventor: Peter Louis Gebrian, Wilmington, Del.

[73] Assignee: Dade International Inc., Deerfield, Ill.

[21] Appl. No.: 675,130

[22] Filed: Jul. 3, 1996

[51] Int. Cl.[6] ..... B01F 9/00; B01F 11/00

[52] U.S. Cl. ..... 366/208; 366/208; 366/219; 366/110; 494/16

[58] Field of Search ..... 366/208, 210, 366/211, 212, 214, 218, 219, 110, 111; 422/63, 99; 494/16, 33

[56] References Cited

U.S. PATENT DOCUMENTS

| | | | |
|---|---|---|---|
| 3,159,384 | 12/1964 | Davis | 366/110 |
| 3,980,165 | 9/1976 | Kesselmark et al. | 192/105 CE |
| 4,655,604 | 4/1987 | Wolf | 366/219 |
| 4,834,548 | 5/1989 | Tempel et al. | 366/208 |
| 4,848,917 | 7/1989 | Benin et al. | 366/208 |
| 4,895,453 | 1/1990 | Devlin et al. | 366/219 |
| 4,943,164 | 7/1990 | Ohishi | 366/149 |
| 5,104,807 | 4/1992 | Mitsumaki et al. | 366/218 |
| 5,183,638 | 2/1993 | Wakatake | 366/218 |
| 5,399,013 | 3/1995 | Sawyer | 366/211 |
| 5,468,067 | 11/1995 | Berkhan et al. | 366/208 |

FOREIGN PATENT DOCUMENTS

| | | | |
|---|---|---|---|
| 160272 | 5/1983 | Germany | 366/208 |

*Primary Examiner*—Tony G. Soohoo
*Attorney, Agent, or Firm*—Leland K. Jordan

[57] ABSTRACT

A vortex mixer which engages and produces a vortex mixing of a liquid within a liquid container by means of centrifugally activated swing-cams. A pair of vertical swing-cams acts to engage the container to the mixer and a horizontal swing-cam provides circular movement to the lower portion of the container. The upper portion of the container is slideably supported so that the container rotates in reaction to the vortex mixing action and thereby produces shear mixing of the liquid.

7 Claims, 10 Drawing Sheets

METHOD AND APPARATUS FOR VORTEX MIXING USING CENTRIFUGAL FORCE

FIELD OF THE INVENTION

In a broad aspect, the present invention relates to methods and apparatus for mixing liquids and liquid suspensions. The present invention is directed to a method and apparatus for mixing biological liquids with additional liquids or liquid suspensions using centrifugal forces to generate a vortex mixing action.

BACKGROUND OF THE INVENTION

Diagnostic analyzers are commercially available to perform chemical analyses of liquids and biological liquids such as urine, blood serum, plasma, cerebrospinal liquid and the like taken from a patient. Generally, reactions between an analyte in biological sample liquid and the reagents used during an analysis take place in a reaction vessel in which a liquid and at least one other liquid or at least one solid reagent are mixed together to form a liquid suspension or reaction solution. The chemical reaction resulting from mixing the sample liquid and solid or liquid reagents generates a characteristic change in the reaction solution that can be detected by the analyzer. The mixing method must produce a homogeneous reaction solution that has a uniform composition throughout to avoid adversely affecting the accuracy of measurement or the reproducibility of analyses of the reaction solution. In addition, the apparatus for mixing liquids must be assembled with a minimum of parts to avoid unduly adding to the cost, complexity, and size of the analyzer.

Creating a whirling or circular motion within a liquid is an effective mixing method to produce homogeneous mixtures. Such motion, called herein vortex mixing, is generated by a vortex mixer to form a cavity in the center of the liquid and draw liquid from the outer portion of the liquid toward the cavity, thoroughly mixing the liquid. Vortex mixers generally rotate the lower portion of a liquid container in a circular path while holding the container stationary; alternately, the top part of the container may be rotated while the lower part remains stationary. Such vortex mixers must address the issue of certain engagement of the container, for example by engaging a protuberant tip at the bottom of each liquid container in a rotatable coupling. Another type of vortex mixer subjects a container with liquids to be mixed to a spinning motion around the container's vertical axis and at the same time subjects the container to a lateral wobbling motion. Such mixing requires a complex mechanism.

Inherent to the design of these vortex mixers, a thin shell of liquid inside the container next adjacent the outer wall is not involved in the vortex mixing as vigorously as is the liquid nearer the center of the container. Increased time is thus required to produce a totally homogeneous solution. The trend toward increased productivity within diagnostic analyzers has thus created a need for vortex mixers that rapidly produce a homogeneous sample solution, while at the same time providing for simple and reliable engagement between the liquid containers and the vortex mixer without introducing costly or complex elements.

SUMMARY OF THE INVENTION

The present invention provides a method for vortex mixing wherein a liquid container is supported such that the container rotates in reaction to the vortex mixing of a liquid therein. The container rotates slowly in a direction counter to the direction of vortex mixing of the liquid. A combination of vortex mixing and shear mixing actions are thereby generated to increase the mixing efficiency.

A rotatable bar is used to freely engage the lower portion of the liquid container. Circular motion applied to the rotatable bar generates a circular movement of the container and results in vortex mixing of a liquid therein. The upper portion of the container is supported in a holding mechanism adapted so that the container can rotate slowly around its centerline in reaction to rapid movement of the lower portion of the container in a circular path around the centerline of the container, herein called circular movement. The rotatable bar and the container are engaged by insertion of a tip on the container within a bore on the rotatable plate. The bore is sized so that the container tip can rotate within the bore. The liquid in the container is thus subjected to vortex mixing created by circular movement of the lower portion of the container and at the same time is subjected to shear mixing as the container rotates slowly in a direction opposite to the direction of circular movement of the lower portion of the container.

When the mixer is in a non-operating position and the liquid in the container is ready to be mixed, the container is presented to the vortex mixer so that the bottom tip of the container is positioned in vertical alignment above a bore in the rotatable bar at a predetermined location. As the mixer is activated, a motor shaft begins to rotate, and when a first sufficient centrifugal force is exerted on a pair of vertical swing-cams connected to the shaft, the vertical swing-cams are forced to pivot radially outwards from the shaft. The rotateable bar is connected to the vertical swing-cams in such a manner that pivoting movement of the vertical swing-cams elevates the rotatable bar from beneath the container to readily engage the tip of the container within the bore.

As the motor shaft is rotated at higher speeds, and when a second sufficient centrifugal force is generated, a horizontal swing-cam is centrifugally forced radially outwards from the shaft and displaces the rotatable bar from its initial tip engaging position. Rotation of the motor shaft thus provides off-centerline circular movement to the lower portion of the reaction vessel and generates vortex mixing of the liquid therein.

BRIEF DESCRIPTION OF THE DRAWINGS

The invention will be more fully understood from the following detailed description thereof taken in connection with the accompanying drawings which form a part of this application and in which.

DETAILED DESCRIPTION OF THE PREFERRED EMBODIMENT

Figure 1:
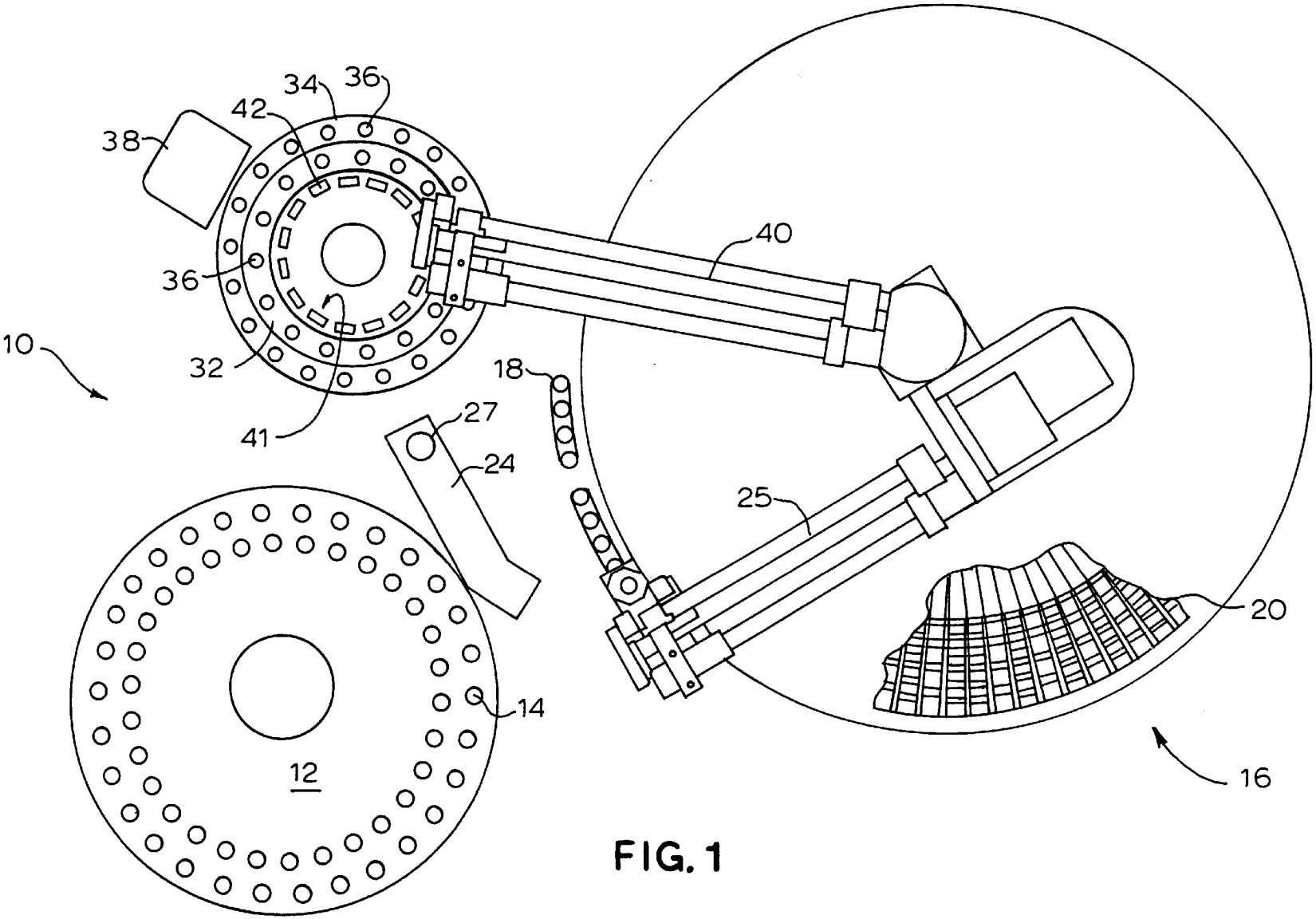
FIG. 1 is a schematic plan view of an automated chemical analyzer in which the present invention may be used.

The method and apparatus of this invention will be described initially with particular reference to FIGS. 1 and 2 of the drawings. FIG. 1 shows schematically the elements of a chemical analyzer 10 having a carousel 12 supporting sample cups 14, a cuvette carousel 16, adapted to hold a plurality of cuvettes 18 and a plurality of reagent cartridges 20. A sample probe 24 is mounted to a rotatable and translatable shaft 27 so that movement of probe 24 intersects the sample cups 14, cuvettes 18 and a plurality of containers 36, herein called reaction vessels 36, on a incubation carousel 34. A first reagent probe 25 is mounted above carousel 16 to withdraw reagents from cartridges 20 and deposit reagents within cuvettes 18 for processing by the analyzer 10. An unprocessed reaction solution is thereby formed in cuvettes 18.

A processing carousel 32 and incubation carousel 34 are independently moveable and both support reaction vessels 36. A transfer station 38 transfers vessels between vessel support slips 81 (illustrated in FIG. 13) formed in carousels 32 and 34. A second reaction solution probe 40 draws reagent from reagent cartridges 20 and deposits withdrawn reagent into a reaction vessel 36 in the incubation carousel 34 where the reaction solution may be incubated or the reaction vessel 36 may be transferred to processing carousel 32 for further treatment.

Processing carousel 32 presents reaction solution to processing devices 41 (FIG. 1) positioned nearby for separation, washing, and mixing before the reaction solution is replaced in a cuvette 18 for analysis. A photometric analyzer, not shown, measures absorbence through the cuvettes 18 at various wavelengths to determine the amount of analyte in the sample liquid. A conventional microprocessor based central operating computer (not shown) is used to control all functions of the automatic chemical analyzer 10 using a combination of general operation and assay-specific computer software programs. Such programs are known in the art and are used in many commercial analyzers.

Figure 3:
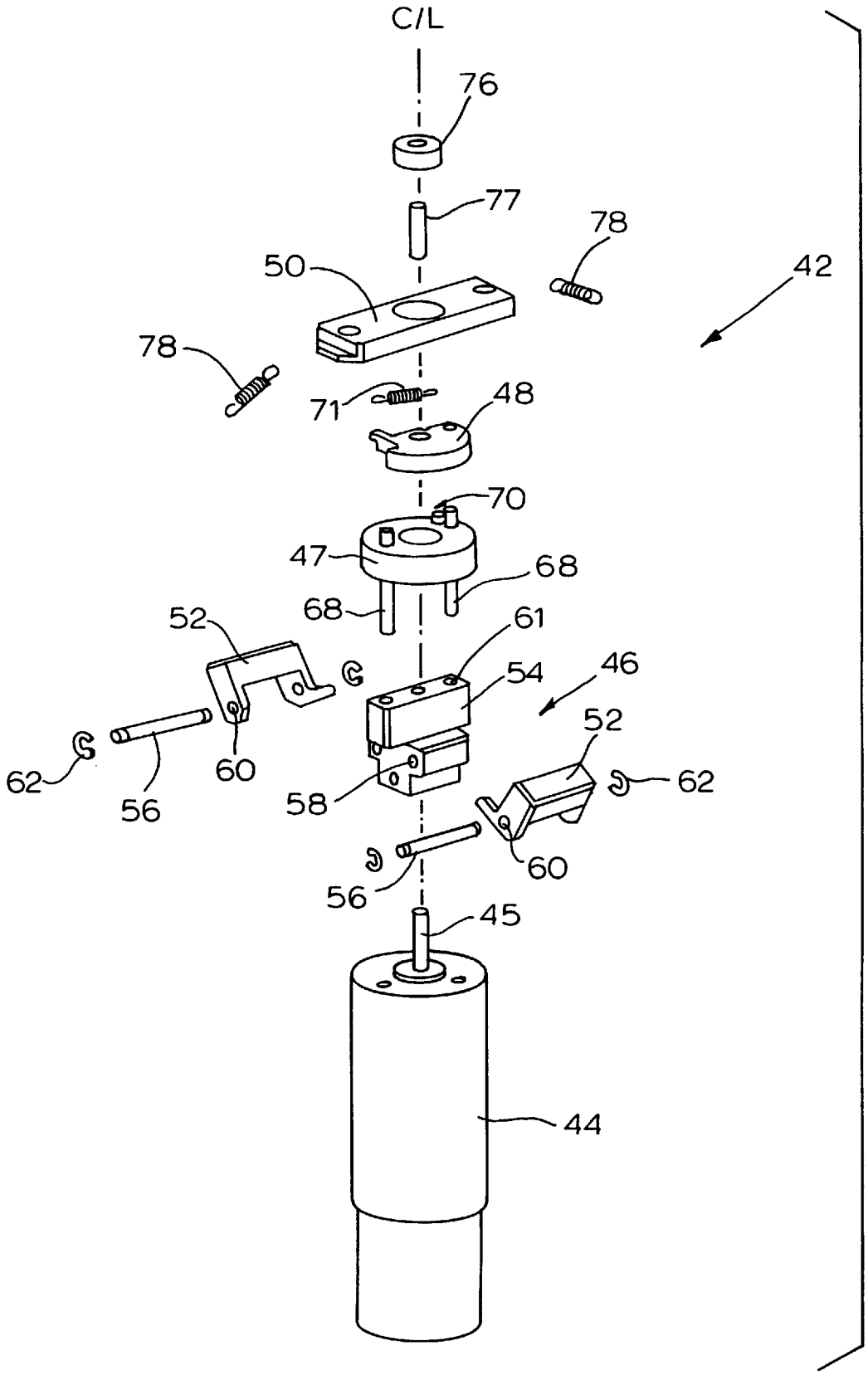
FIG. 3 is a exploded perspective view of the exemplary vortex mixer of FIG. 2.
Figure 8A:
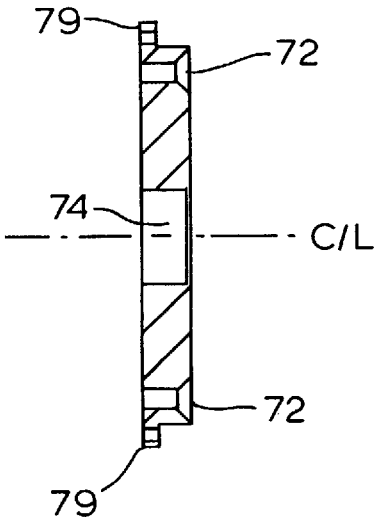
FIG. 8A is a cross-sectional view of the rotatable bar of FIG. 8.
Figure 8:
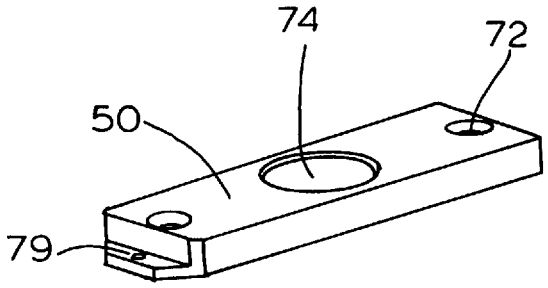
FIG. 8 is a perspective view of a rotatable bar useful in the exemplary vortex mixer of FIG. 2.

A vortex mixer 42 exemplary of the present invention is positioned proximate the processing carousel 32 for performing vortex and shear mixing actions upon the reaction solution contained within reaction containers or vessels 36. The reaction vessels 36 are placed in a slot 81 by the transfer station 38 and are supported on the processing carousel 32 with a holding mechanism adapted so that the container can rotate around its centerline within the holding mechanism. Exemplary of such a holding mechanism are, for instance, adjustable tongs, a vise, or other such grasping device, like a frictional clamp 80 (FIG. 13) used herein to further describe but not limit the present invention. Frictional clamp 80 is a slotted, low-tensile strength spring clamp that restrains the reaction vessel 36 using frictional forces that may be adjusted by bending the spring clamp against the processing carousel 32. A reaction vessel engagement bar 50 is illustrated in FIGS. 3 and 8 as supporting two reaction vessels 36 for processing efficiency. A single reaction vessel 36 may also be supported by vessel engagement bar 50. The reaction vessel engagement bar 50 is aligned beneath the reaction vessel 36 and is first elevated by a centrifugally activated vertical-cam mechanism described later to engage the lower portion of the reaction vessel 36 on the engagement bar 50. Next, a centrifugally activated horizontal-cam mechanism described later provides oscillating movement to the engagement bar 50 and thereby to the lower portion of reaction vessel 36 to generate vortex mixing of the reaction solution therein. Because the reaction vessel 36 is free to rotate within the clamp 80 in response to circular movement of the lower portion of the reaction vessel 36, the reaction solution within reaction vessel 36 is also subjected to shear mixing that results when contigious portions of the reaction solution, particularly the thin layer adjacent the reaction vessel and the reaction solution nearby, are subjected to movement relative to one another.

Figure 2:
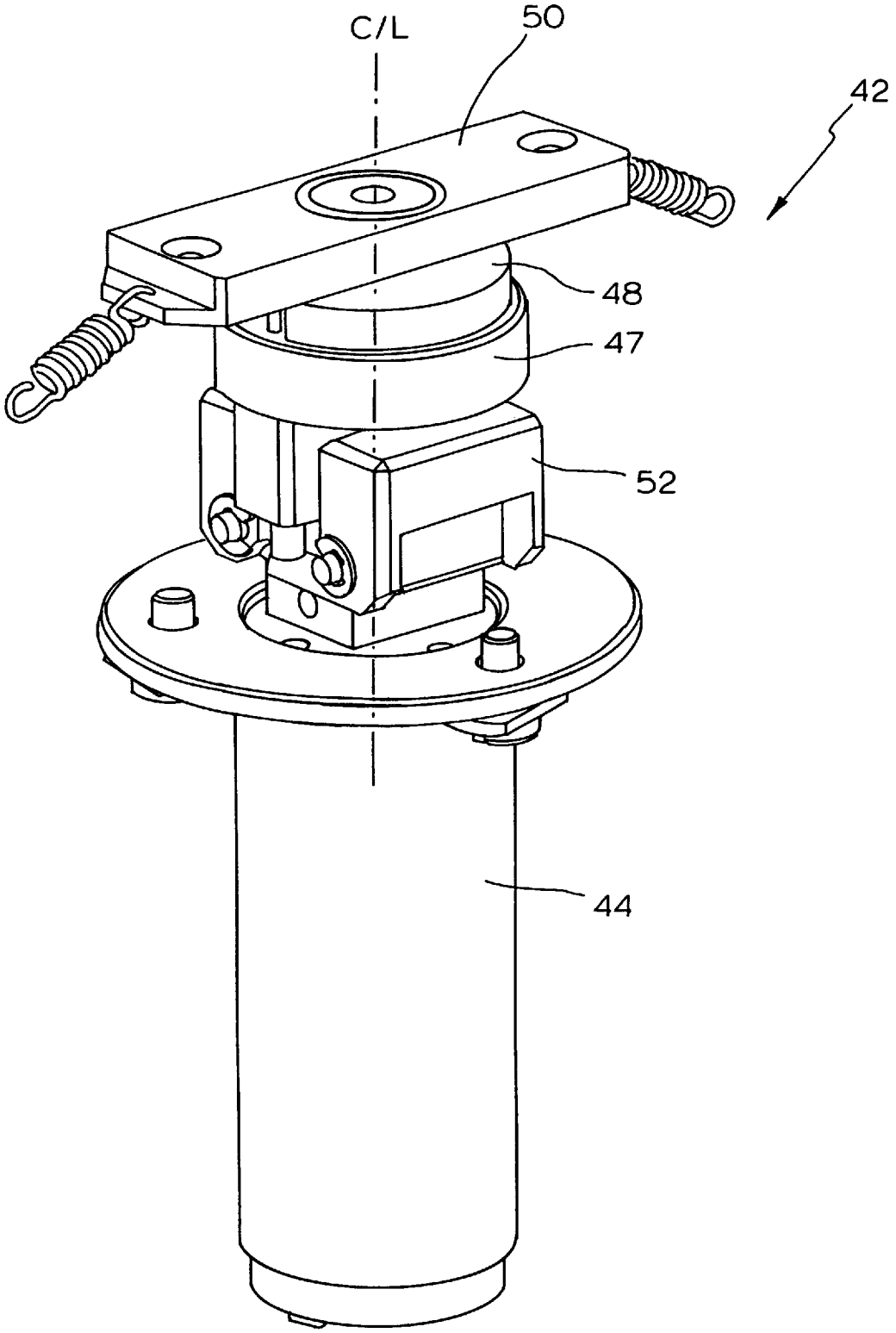
FIG. 2 is a perspective view of an exemplary vortex mixer suitable for performing the present invention.

FIGS. 2 and 3 show a vortex mixer 42 suitable for performing the present invention, the mixer 42 comprising a conventional motor 44 for providing rotational movement of a shaft 45 (best seen in FIG. 3) around a centerline C/L of the vortex mixer 42, a pair of vertical swing-cams 52 attached to a lifter 54 mounted on shaft 45 and a horizontal swing-cam 48 attached to a pin support plate 47 secured to the vertical swing-cams 52, both vertical swing-cams 52 and horizontal swing-cam 48 being driven by the motor 44 in a manner to produce centrifugal forces on the elements 52 and 48. Swing-cams are sometimes known as swing-weights, fly-weights or fly-ball governors in other applications. As explained hereinafter, during operation of the vortex mixer 42, when the vortex mixer 42 is activated by a first sufficient centrifugal force, the pair of vertical swing-cams 52 is adapted to provide vertical positioning of a reaction vessel engagement bar 50 so that a reaction vessel 36 supported on processing carousel 32 is engaged thereto but is free to rotate about its own centerline C2/L2 (illustrated in FIG. 9). By "first sufficient centrifugal force" is meant that centrifugal force required to overcome the totality of forces maintaining the pair of vertical swing-cams 52 in a stationary position, including forces exerted by a pair of locator springs 78 described hereinafter, and to cause the pair of vertical swing-cams 52 to pivot outwardly. When the vortex mixer 42 is activated by a second sufficient centrifugal force, a horizontal swing-cam 48 moves radially outwardly to displace the reaction vessel engagement bar 50 away from the vertical centerline of reaction vessel 36 when it is first engaged by the vortex mixer 42. By "second sufficient centrifugal force" is meant that centrifugal required to overcome the totality of forces maintaining the horizontal swing-cam 48 in a stationary position, including forces exerted by tensile forces from a spring 71 (illustrated in FIGS. 3, 10A and 11A) and restorative forces of frictional clamp 80 securing vessels 36 in a normally perpendicular orientation and cause the swing-cam 48 to pivot outwardly. Rotation of the motor shaft 45 at a speed equal to or greater than the speed generating the second sufficient centrifugal force thus causes the reaction vessel engagement bar 50 to move in a circular path and thereby to provide a off-center circular movement to reaction vessels 36 engageably supported thereon. This circular movement of the reaction vessels 36 creates a vortex mixing of the reaction liquids contained therein.

FIG. 3 shows vertical swing-cam 52 shaped like a rocker and pivotably affixed to opposing sides of a lifter 54 by means of a pair of shafts 56 disposed within bores 58 and extending therethrough. Both ends of shafts 56 protrude from bores 58 and extend through openings 60 in the vertical swing-cams 52. Shafts 56 are secured at their exposed ends, for example using ring clamps 62.

Figure 4A:
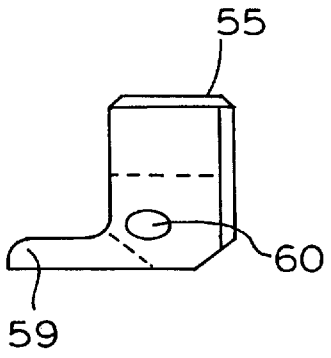
FIG. 4A is a side elevation view of the vertical swing cam of FIG. 4.
Figure 4:
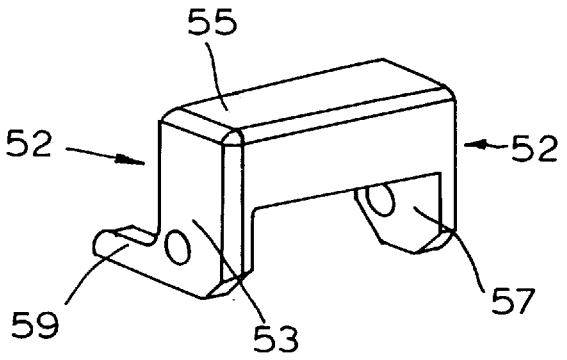
FIG. 4 is a perspective view of a vertical swing cam useful in the exemplary vortex mixer of FIG. 2.

FIG. 4 further shows vertical swing-cam 52 as having a generally rectangular table-like shape with an L-shaped leg-portion 53 extending downwardly from a main body portion 55 and with a straight-shaped leg portion 57 also extending downwardly from main body portion 55. FIG. 4A shows a foot section 59 extending from the lowermost horizontal part of the L-shaped leg-portion 53. In assembly, foot section 59 is positioned in contact with one of a pair of lifter pins 68 (FIG. 3 ) so that the lifter pin 68 is moved upwards as the main body portion 55 is moved outwardly from the centerline C/L and foot section 59 is moved upwardly. The other member of the pair of swing-cams 52 is affixed to the lifter 54 in an opposing relationship with the first member of the pair of swing-cams 52 so as to maintain symmetrical weight balance of the vortex mixer 42. The foot-section 59 of the other member of the pair of swing-cams 52 is thus correspondingly positioned in contact with the other of the pair of lifter pins 68.

Figure 5:
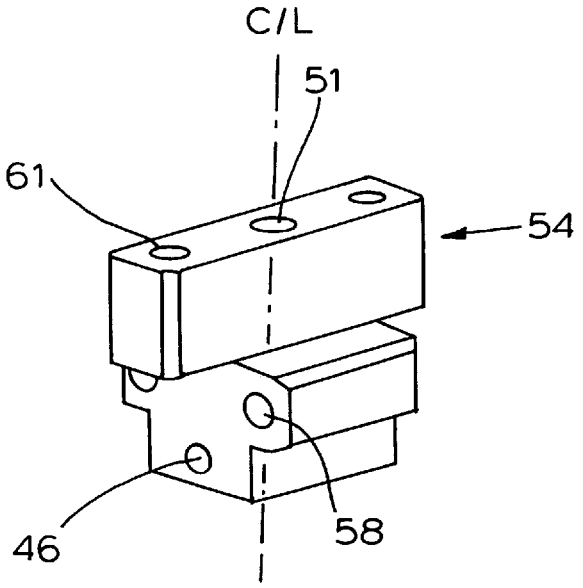
FIG. 5 is a perspective view of a lifter useful in the exemplary vortex mixer of FIG.2.

FIG. 5 shows lifter 54 comprising a lower portion having a pair of parallel bores 58 extending horizontally therethrough in perpendicular relationship to a central bore 51 aligned with centerline C/L and an upper portion having a second pair of parallel bores 61 extending vertically through the upper portion of lifter 54 parallel to but radially displaced from the central bore 51. Lifter element 54 may be secured to shaft 45 using, for example, a set-screw (not shown) in a threaded bore 46 intersecting shaft 45 within central bore 51. The second pair of parallel bores 61 (also seen in FIG. 3) encase the pair of vertically oriented lifter pins 68 in a sliding relationship. In operation, as the motor 44 is activated to rotate the shaft 45, first sufficient centrifugal forces are generated that cause the pair of swing-cams 52 to rotate outwardly from the centerline C/L. Because of the L-shape of vertical swing-cams 52, the foot-like sections 59 move upwardly elevating the pair of lifter pins 68 to engage the vortex mixer 42 with reaction vessel 36. Thus, the reaction vessel 36 is engaged by the vortex mixer 42 using the same motor 44 that supplies mixing movement to the reaction vessel 36, simplifying the design and assembly of analyzer 10.

Figure 6:
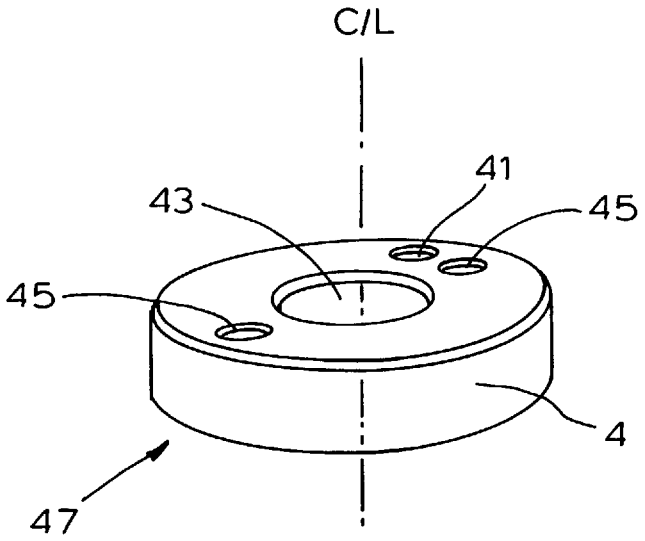
FIG. 6 is a perspective view of a pin support plate useful in the exemplary vortex mixer of FIG. 2.

FIG. 6 shows a roundly shaped pin support plate 47 having a central opening 43 aligned with the centerline C/L and a pair of openings 45 positioned near its circumference in alignment with the pair of parallel bores 61. Each of the lifter pins 68 extends through openings 45 in pin support plate 47 ( illustrated in FIG. 3) an distance sufficient to engage a horizontal swing-cam 48, described in conjunction with FIG. 7. Lifter pins 68 are secured to pin support plate 47 using an interference fit. Recess 43 is sized to allow a predetermined amount of free horizontal movement of a bearing pin 77 extending thereinto (illustrated in FIGS. 3, 10A, and 11A), the movement of bearing pin 77 being perpendicular to centerline C/L. Since bearing pin 77 is secured to the horizontal swing-cam 48, the outward pivoting movement of horizontal swing-cam 48 is limited, as described hereinafter in conjunction with operation of the vortex mixer 42 and FIGS. 3 and 8. A spring pin bore 41 is positioned near the circumference of pin support plate 47, also angularly displaced from one of the openings 45. A spring pin 70 (illustrated in FIG. 3) is secured within spring pin bore 41 in an interference fit extending vertically upwards.

Figure 7:
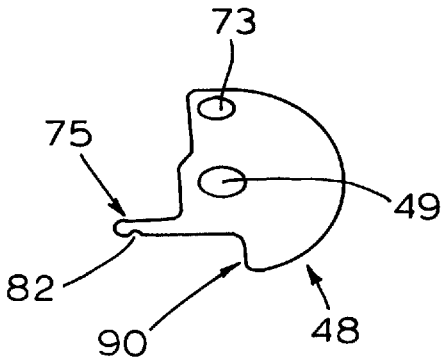
FIG. 7 is a plan view of a horizontal swing cam useful in the exemplary vortex mixer of FIG. 2.
Figure 7A:
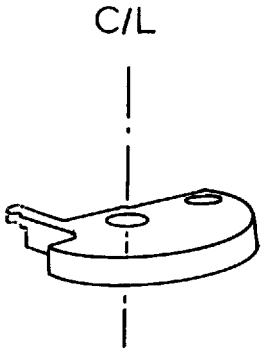
FIG. 7A is a perspective view of the horizontal swing cam of FIG. 7.
Figure 10:
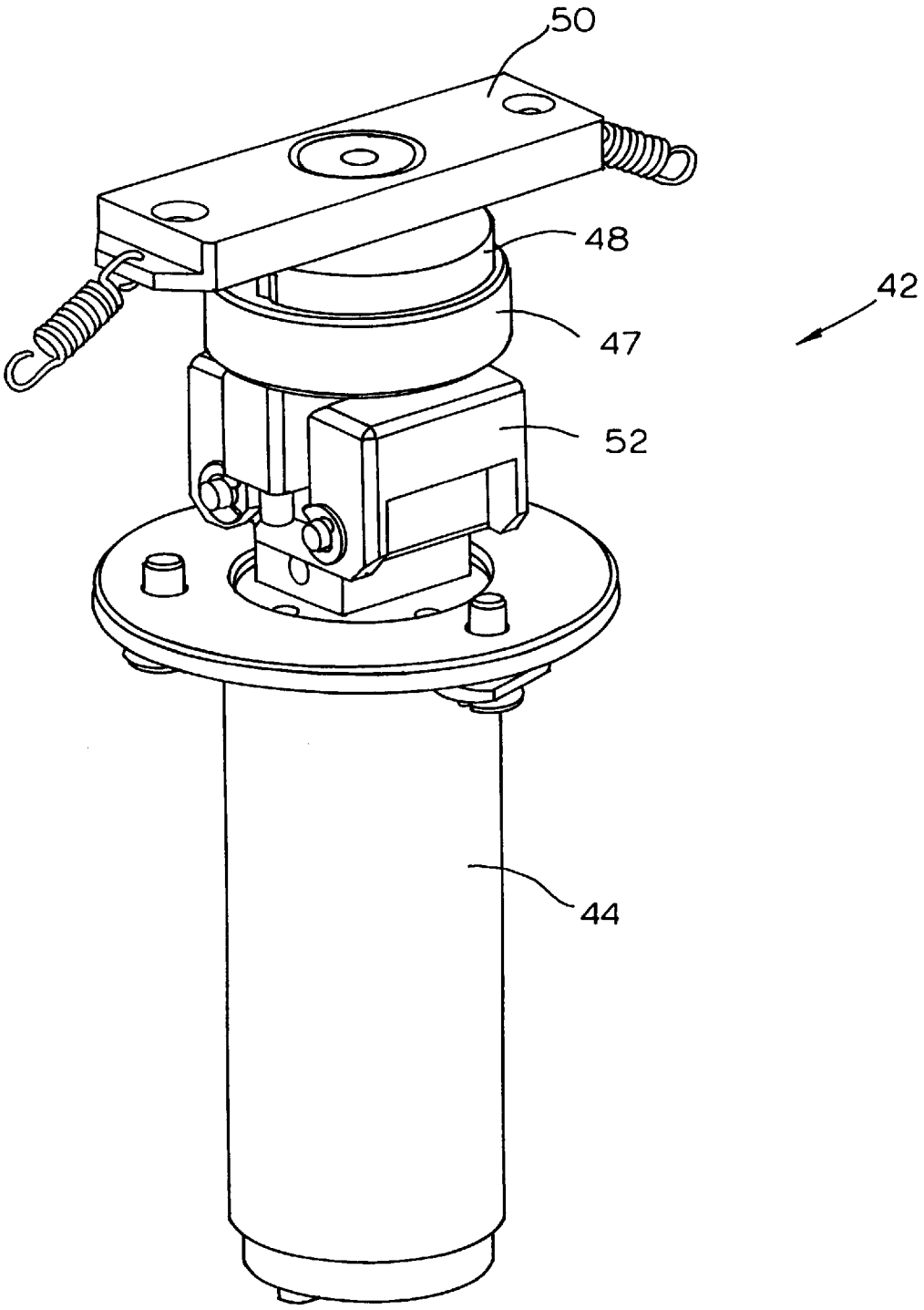
FIG. 10 is a plan view of the horizontal swing cam of FIG. 7 in a non-activated position.

FIG. 7 further illustrates the horizontal swing-cam 48 having a generally hemispherical plane shape, a centrally located bearing pin bore 49 aligned with centerline C/L shown in FIG. 7A and a circumferential bore 73 positioned in the outer portion of swing-cam 48 as illustrated. Swing-cam 48 is sized and shaped so that one of the pair of lifter pins 68 secured in pin support plate 47 and extending upwards therethrough (illustrated in FIGS. 3, 10A and 11A) rests against a cut-out section, generally indicated by the numeral 90, located opposite the circumferential bore 73. Circumferential bore 73 is sized so that the horizontal swing-cam 48 is rotatably mounted on the other of the pair of lifter pins 68 extending through pin support plate 47 (illustrated in FIG. 3) so that the horizontal swing-cam 48 is pivotably mounted to the pair of swing-cams 52. Section 90 functions as a stop for pivoting displacement of the horizontal swing-cam 48 against one of the extending through lifter pins 68. A projection 75 extends away from the body of the swing-cam 48, the projection 75 having a semicircular groove 82 near its end as shown in the FIG. 7, the groove 82 cut to accept one end of a swing-cam spring 71. Spring 71 is positioned between the spring pin 70 mounted in pin support plate 47 and groove 82 in swing-cam 48 under extended tension to retain the swing-cam 48 in a closed position with stopping contact between the swing-cam 48 and the lifter pin 68 when the lifter 54 is not being rotated by motor 44 (illustrated in FIG. 10). The tensile strength of spring 71 may be selected so as to determine the rotational speed of shaft 45 at which second sufficient centrifugal forces occur.

FIG. 8 shows a reaction vessel engagement bar 50 having two countersunk reaction vessel tip ports 72 near the two ends of the vessel engagement bar 50 and a central bore 74 aligned with centerline C/L ( illustrated in FIG. 8A), bore 74 sized to accept a bearing 76 (illustrated in FIG. 3) using an interference fit. The countersunk ports 72 are sized to accept a protuberant tip 37 located at the bottom of reaction vessels 36 (illustrated in FIG. 9) a depth into the countersunk ports 72 so that the reaction vessels 36 are securely engaged by the vortex mixer 42. The diameters of countersunk ports 72 and diameters of protuberant tip 72 are chosen so that the protuberant tip 37 is free to rotate within the countersunk ports 72 leaving reaction vessel 36 freely rotateable relative to the bar 50. For example, a 0.078 inch diameter of countersunk ports 72 and a 0.062 inch diameter of protuberant tip 72 has been used in exemplary vortex mixer 42.

Two spring holes 79 are formed in the vessel engagement bar 50 at its ends, with one end of support plate springs 78 attached to the holes 79 and the other end attached to a stationary frame 92 of the analyzer 10 to provide flexible anchoring of the vessel engagement bar 50 and assist in restoring the vessel engagement bar 50 to its original position when the mixer 42 is de-activated. A bearing pin 77 (illustrated in FIG. 3) is secured into the bearing 76 and extends downwardly through bearing pin bore 49 of the horizontal swing-cam 48 into opening 43 of the pin support plate 47. Consequently, the vessel engagement bar 50 is attached to the swing-cam 48 by means of the bearing pin 77 secured within bearing pin bore 49.

As motor 44 rotates shaft 45 at increasing speeds, centrifugal forces are generated that act against the restraining force of pin spring 71. The tensile strength of spring 71 may be chosen so that this pivoting motion occurs only after a desired predetermined rotational speed of the motor shaft 45 is achieved. Once this rotational speed of the motor shaft 45 is exceeded, centrifugal forces cause horizontal swing-cam 48 to rotate outwardly from the centerline C/L, pivoting on the lifter pin 68 secured in pin support plate 47 (illustrated in FIG. 11A). Because pin 77 is captured within recess 43, horizontal swing-cam 48 is allowed to rotate outwardly a distance about equal to one-half the diameter of the recess 43. The outward movement of bearing pin 77 causes bearing 76 and vessel engagement bar 50 to move perpendicularly to the centerline C/L a distance also about equal to one-half the diameter of the recess 43. Because horizontal swing-cam 48 is attached to pin support plate 47 with a lifter pin 68 at the outer circumference of swing-cam 48, the displaced pin 77 is moved in a circular path. This circular path is translated to bearing 76 and vessel engagement bar 50 and moves the lower portion "L" of a reaction vessel 36 engaged in vessel engagement bar 50 in a similar circular path.

Figure 9:
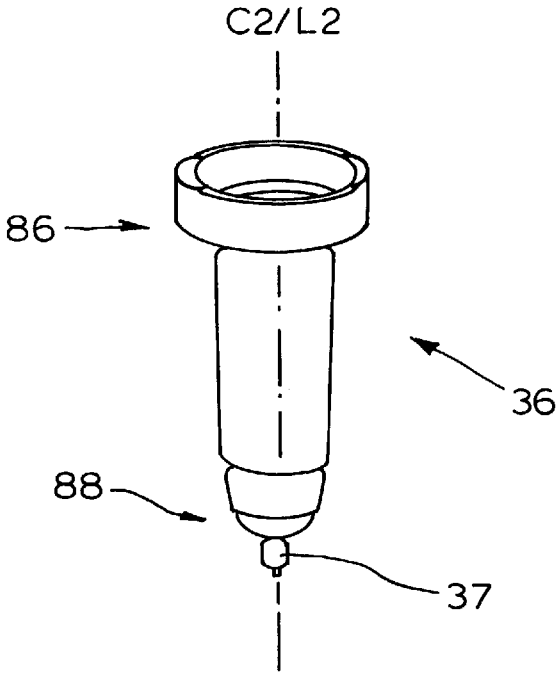
FIG. 9 is a perspective view of a reaction vessel suitable for containing liquids to be mixed by the exemplary vortex mixer of FIG. 2.
Figure 12:
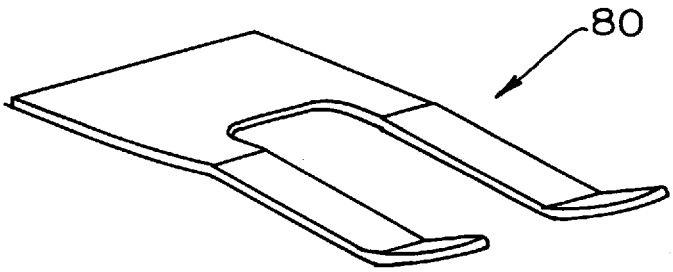
FIG. 12 is a perspective view of a frictional clamp useful in the exemplary vortex mixer of FIG. 2; and, FIG. 13 is a schematic illustration of the exemplary vortex mixer of FIG. 2 in mixing motion.

FIG. 9 shows reaction vessel 36 having a centerline C2/L2 with a protuberant tip 37 located in a lower portion 88 of the vessel 36 opposite the upper portion 86 of the vessel 36 that is restrained in processing carousel 32 using a source of friction, for example, using a frictional clamp or leaf-spring 80 like that shown in FIG. 12. In an exemplary embodiment of the present invention, the restraining forces created by frictional clamp 80 and acting on reaction vessel 36 being designed so that the reaction vessel 36 rotates around the central axis of the vessel 36 in reaction to circular motion of the lower portion 88 of the reaction vessel 36.

In operation, the vessel engagement bar 50 is normally recessed about 0.050 inches below the reaction vessels 36, so that the vessel tips 37 will clear the vessel engagement bar 50 when the processing carousel 32 is advanced to present reaction vessels 36 to various stations 41 including vortex mixer 42. When vessels 36 are scheduled for mixing of the reaction solution contained therein, processing carousel 32 is advanced to present reaction vessels 36 to vortex mixer 42. A mixing action is initiated by the central operating computer of the automatic chemical analyzer 10 using a software program to activate and control the speed of motor 44 and motor shaft 45. Motor 44 may be a DC gearmotor, for example as supplied by SDP Metric, 24 volts DC, 20mm diameter, capable of no-load rotational speeds from 0–1500 rpm, or alternately, Maxon DC Motors (Fall River, Mass,), capable of no-load speeds from 0–10,000 rpm.

Figure 11A:
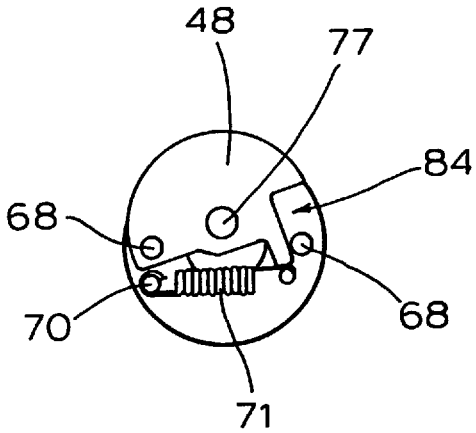
FIG. 11A is a plan view of the horizontal swing cam of FIG. 7 in an activated position.
Figure 11:
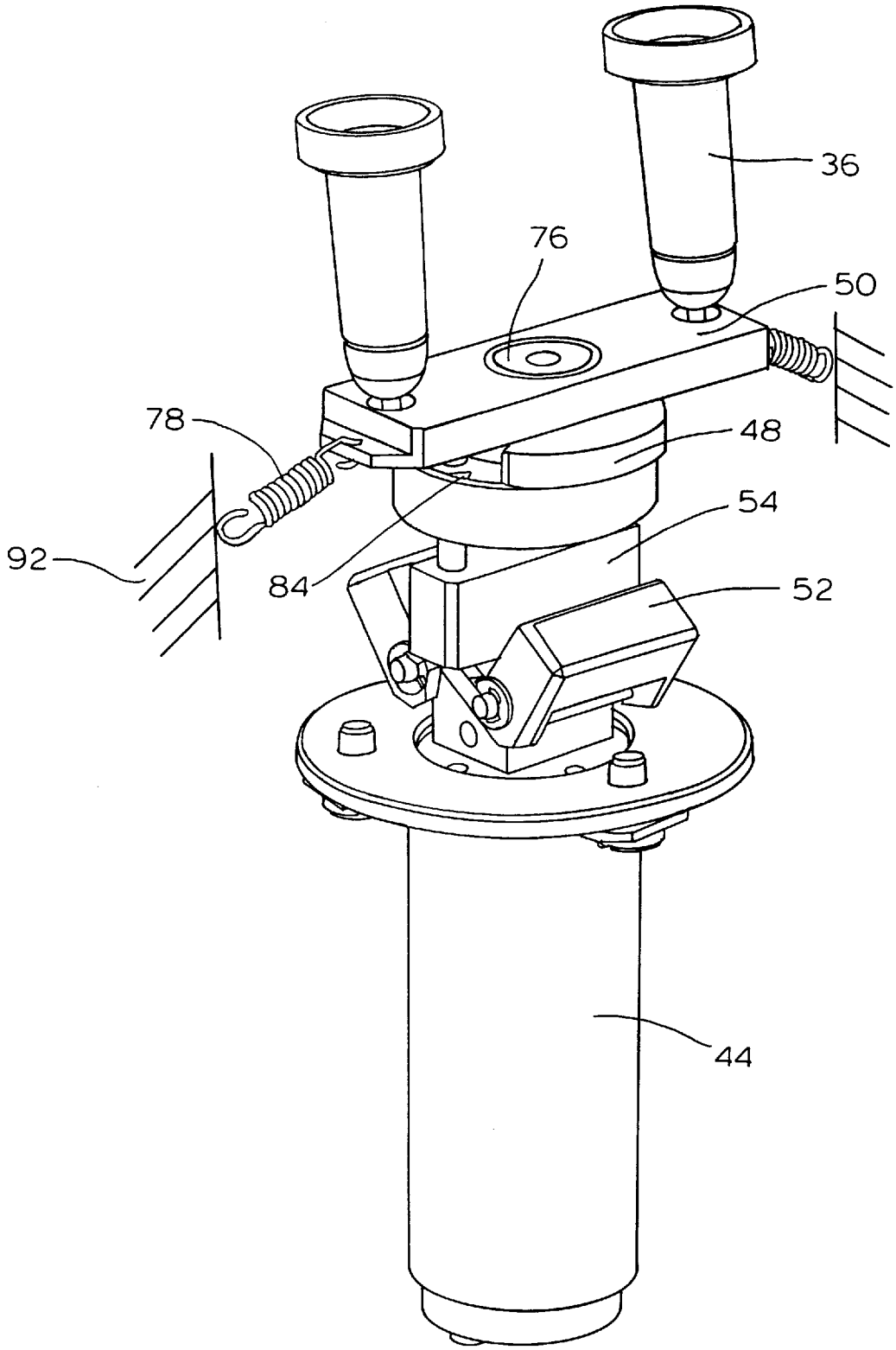
FIG. 11 is a perspective view of the exemplary vortex mixer of FIG. 2 in an operating position.

The weight and weight distribution of the pair of vertical swing-cams 52 are selected so that as the rotation speed of motor shaft 45 is increased from a resting position, a lifting action is imparted to the reaction vessel engagement bar 50 so that the reaction vessels 36 are operatively engaged by seating tips 37 within the two countersunk reaction vessel tip ports 72. Centrifugal forces created by rotation of motor shaft 45 are exerted on the pair of vertical swing-cams 52 attached to the lifter 54 causing the main body portion 55 to pivot radially outwardly (like a rocker on shafts 56 disposed within bores 58) at a first sufficient centrifugal force. At the first sufficient centrifugal force, the amount of centrifugal force exerted on the vertical swing-cams is large enough to overcome the totality of forces acting to maintain the vertical swing-cams 52 in a stationary position, including forces exerted by the pair of locator springs 78 and gravitational forces arising from weight of the support plate 47, the horizontal swing-cam 48 and the support bar 50. For example, if the vertical swing-cams 52 are about 0.25 inches by about 0.62 inches in size formed of stainless steel and weigh about 0.2 ounces, the first sufficient centrifugal force required to activate the pair of swing-cams 52 occurs at a rotational speed in the range 250–400 rpm. This outward pivoting action of vertical swing-cams 52 moves the foot portion 59 upwardly which displaces the pair of lifter rods 68 (illustrated in FIG. 3) upwards. The results of this upward displacement are shown in FIG. 11, the lifter pins 68 extending through bores 61 within lifter 54 having been displaced upwardly to cause the pin support plate 47, horizontal swing-cam 48 and vessel engagement bar 50 to move upwards and engage protuberant tips 37 on reaction vessels 36. Suitable reaction vessels 36 have been made of polypropylene about 5/16 inch diameter and 1 inch in height, containing a sample liquid of about 300 microliters, and having tip 37 dimensions of about 0.62 inch diameter and 0.10 inch length. The positioning of vessel engagement bar 50 by locator springs 78 is such that the countersunk bores 72 are in vertical alignment with protuberant tips 37 of reaction vessels 36 supported on carousel 32 when the mixer 42 is non-activated, thereby eliminating randomness in the engagement process between the mixer apparatus 42 and reaction vessels 36. This positioning is accomplished by attaching a pair of locator springs 78 to the frame, indicated by 92 in FIG. 10, of the analyzer 10 so that the tips 37 of reaction vessels 36 are vertically aligned with tip ports 72 of vessel engagement bar 50 when the mixer 42 is non-activated. Conventional sensor means (not shown) may be employed to confirm that this reaction vessel contacting position is achieved.

Figure 10A:
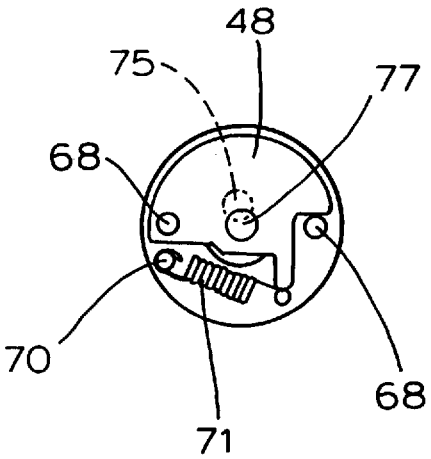

As the operating speed of the motor 44 continues to increase after the reaction vessels 36 are secured to the vessel engagement bar 50, and when the amount of centrifugal force exerted on the horizontal swing-cam 48 is greater than the second sufficient centrifugal force, the horizontal swing-cam 48 pivots radially outwardly on lifter pin 68. For example, if pin spring 71 is formed of stainless steel wire rated 0.63 LB/inch, (part number E1-010B-3, Lee Springs Brooklyn, N.Y.) and horizontal swing-cam 48 was about 0.10 inches by 0.75 inches in size formed of stainless steel and weighed about 0.1 ounces, the second centrifugal force sufficient to activate the horizontal swing-cam 48 was found to occur at a rotational speed in the range 400 to 600 rpm. For purpose of illustration, a gap generally indicated by 84 in FIGS. 11 and 11A is shown opened up between the horizontal swing-cam 48 and lifter pin 68. Gap 84 results from the pivoting action of horizontal swing-cam 48. This pivoting action is best illustrated by considering FIGS. 10A and 11A in combination. In FIG. 10A, swing-cam 48 is restrained against one of the lifter pins 68 by pin spring 71 and is illustrated not radially pivoted outwardly on lifter pin 68. This situation exists whenever the vortex mixer is non-activated or if the centrifugal force supplied from motor shaft 45 is less than the second sufficient centrifugal force required to overcome the restraining force of spring pin 71. FIG. 11A illustrates the displaced position of the horizontal swing-cam 48 whenever the motor shaft 45 is rotating at a speed sufficiently high to generate a centrifugal force greater than the second sufficient centrifugal force and overcome the restraining forces exerted on the horizontal swing-cam 48 by pin spring 71. In this situation, horizontal swing-cam 48 pivots radially outwardly on lifter pin 68, creating gap 84 and displacing bearing pin 77 to displaced position 75 shown in dashed lines in FIG. 10A a distance less than about one-half the diameter of the recess 43. The horizontal displacement of bearing pin 77 moves bearing 76 and vessel engagement bar 50 a distance also about equal to one-half the diameter of the recess 43. In an exemplary embodiment, recess 43 was sized about 0.32 inches diameter, bearing pin 77 was formed of stainless steel having a diameter 0.125 inches and bearing 76 was obtained from MMB Bearings, Old Bridge, N.J., with an OD of 0.375 inches and an ID of 0.125 inches suitable for use at rotational speeds between 0 and 3000 rpm.

Pin support plate 47 and lifter 54 are attached to shaft 45 and rotate around the centerline C/L at the same speed as the motor shaft is driven. Because horizontal swing-cam 48 is pivotably attached to pin support plate 47 by one of the lifter pins 68, the displaced bearing pin 77 is moved in a circular path as the pin support plate 47 is rotated by motor shaft 45. This circular movement is translated to bearing 76 and vessel engagement bar 50 and moves the lower portion "L" of a reaction vessel 36 engaged in vessel engagement bar 50 in a similar circular path. Because the upper portion 86 (illustrated in FIG. 13A) of the reaction vessels 36 is constrained by frictional clamp 80 on the processing carousel 32, a vortexing mixing action is imparted to the reaction solution contained in the reaction vessel 36. Thus, the reaction solution is mixed using the same motor 44 that supplies engaging action of the vortex mixer 42 to the reaction vessel 36, simplifying the design and decreasing the size of the mixer 42.

Figure 13A:
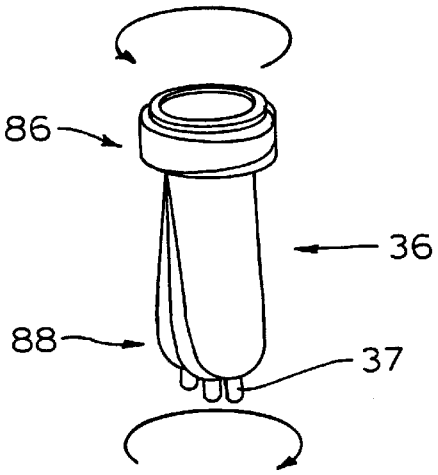
FIG. 13A is a schematic illustration of the reaction vessel of FIG. 9 in mixing motion.
Figure 13:
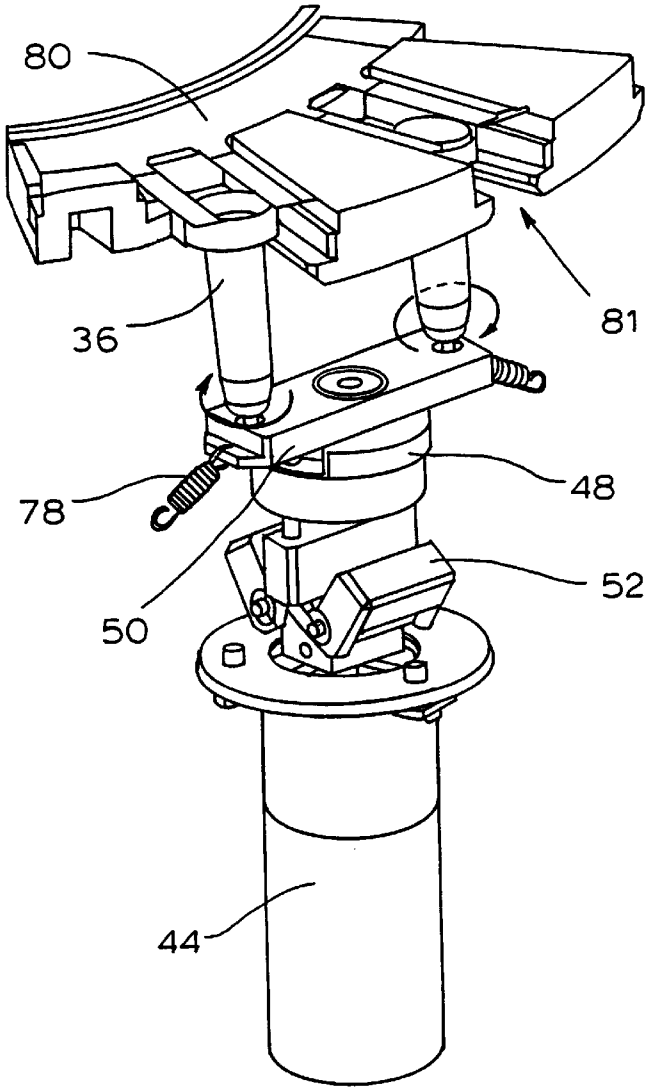

The shear mixing feature of the present invention is achieved by sizing the vessel-constraining force of the vessel support mechanism or frictional clamp 80, so that in reaction to the circular motion of the lower portion 88 of reaction vessels 36, the reaction vessel 36 slideably rotates within the vessel support slip 81 in a direction opposite to the circular motion. For purposes of clarity in the illustration, much of the surroundings, including the stationary walls that locator springs 78 are linked to, have been removed from FIG. 13. If stainless steel spring stock a tensile strength in the 120,000/in$^2$ to 160,000/in$^2$ range is used to form the frictional clamp 80 into a fork-shape (to facilitate positioning of the reaction vessels 36 within vessel support slip 81), a downward force of about 2 to 4 ounces can be achieved by bending the spring stock to clamp the reaction vessel 36 onto the processing carousel 32. Using a vessel engagement bar 50 about 0.12 inches by 2.0 inches in size formed of aluminum and weighing about 0.1 ounces, with the horizontal swing-cam 48 circularly moving at a rate in the range 400 to 600 rpm, the lower portion 88 of the reaction vessel 36 is also circularly moved at about 400 to 600 rpm, the reaction vessel 36 rotates slideably within frictional clamp 80 in an opposite direction at about 4 to 12 rpm, slowed by the constraining frictional forces applied by the frictional clamp 80. This opposing rotation of the reaction vessels 36 provides a greater mixing efficiency of the liquids therein than is achieved if the frictional forces of frictional clamp 80 are so great as to maintain the reaction vessel 36 in a stationary position. FIG. 13 shows two reaction vessels 36 positioned within vessel support slips 81 formed in carousel 32 and constrained in position by a frictional clamp 80, in this example, a band of stainless steel like described above. FIGS. 11 and 13 illustrate the vortex mixer 42 in operation with a first sufficient centrifugal force already applied (by motor shaft 45) to the pair of swing-cams 52 to cause them to pivot outwards elevating vessel engagement bar 50 into engagement with the reaction vessels 36, and, a second sufficient centrifugal force already applied (by motor shaft 45) to swing-cam 48 to cause it to pivot outwards forcing the centerline C2/L2 of reaction vessel 36 to deflect from its original vertical orientation. Because the lower portion 88 of the reaction vessel is displaced from directly beneath the upper portion 86, rotation of the motor shaft is translated into a vortexing motion of the reaction vessel 36. In reaction to the circular motion of the lower portion 88 of reaction vessels 36, the reaction vessel 36 slideably rotates against the constraining forces created by the frictional clamp 80. The direction of rotation is opposite to the direction of vortexing motion of the lower portion 88 of reaction vessels 36 thereby producing a shearing effect within the reaction solution. FIG. 13A illustrates this opposing rotation with one arrow indicating clockwise movement of the tip 37 in the lower portion 88 and the other arrow indicating counter-clockwise movement of the reaction vessel 36 within the frictional clamp 80. Any of several types of low-friction devices, for example, a simple weight may be used to perform the function of frictional clamp 80 as long as the restraining fiction can be adjusted within an appropriate range.

The materials of construction of the components of the mixer 42 may be chosen from a variety of readily available metals and plastics, preferably aluminum and acetyl having been successfully employed in an exemplary embodiment of the present invention. If the weights and dimensions of vessel engagement bar 50, horizontal swing-cam 48, reaction vessel 36, the tension of spring pin 71 or the vertical swing-cams 52, for example, are changed, the rotational speeds at which lifting and mixing actions occur will change accordingly.

It is to be understood that the embodiments of the invention disclosed herein are illustrative of the principles of the invention and that other modifications may be employed which are still within the scope of the invention. For instance, the lower portion of a reaction vessel may be constrained and the upper portion subjected to vortex mixing resulting in the same combination of vortex and shear mixing. Accordingly, the present invention is not limited to those embodiments precisely shown and described in the specification but only by the following claims.

What is claimed is:

1. A method for vortex mixing a liquid solution in a container, the container having upper and lower portions, the lower portion being engaged on a holding mechanism, the holding mechanism comprising an engagement bar having a pair of vertical swing-cams attached thereto and adapted to provide vertical displacement of the engagement bar and a horizontal swing-cam attached thereto and adapted to provide horizontal displacement of the engagement bar;

the method comprising:

rotating the holding mechanism at a first speed to apply a first sufficient centrifugal force to the vertical swing-cams so that the engagement bar is elevated vertically and engages the lower portion of the container.

rotating the holding mechanism at a second speed to apply a second sufficient centrifugal force to the horizontal swing-cam so that the horizontal swing-cam moves the engagement bar radially outwardly; and, continuing to rotate the holding mechanism to mix the liquid solution in the container.

2. The method for vortex mixing a liquid solution of claim 1 wherein the upper portion of the container is supported with a frictional clamp, the friction of the frictional clamp on the container being established so that the container rotates within the holding mechanism in response to rotational movement of the holding mechanism.

3. The method for vortex mixing a liquid of claim 2 wherein the container rotates within the frictional clamp in a direction opposite to the direction of rotational movement of the holding mechanism.

4. A vortex mixer for mixing a liquid in a container, the container having upper and lower portions, the apparatus comprising:

a container engagement bar disposed below the container and engaging the lower portion of said container;

a horizontal swing-cam attached to the engagement bar and adapted to provide horizontal displacement of the engagement bar;

a pair of vertical swing-cams attached to the engagement bar and adapted to provide vertical displacement of the engagement bar; and, a source of centrifugal force connected to said engagement bar.

5. The vortex mixer for mixing a liquid of claim 4 further comprising a frictional clamp to support the upper portion of the container.

6. The vortex mixer of claim 5 wherein the restraining force of the frictional clamp is established so that the container rotates within the frictional clamp in reaction to circular movement of the engagement bar.

7. The vortex mixer of claim 6 wherein the restraining force of the frictional clamp is established so that the container rotates within the frictional clamp in a direction opposite to the direction of rotational movement of the holding mechanism.

* * * * *

UNITED STATES PATENT AND TRADEMARK OFFICE

CERTIFICATE OF CORRECTION

PATENT NO. : 5,813,759

DATED : September 29, 1998

INVENTOR(S) : Peter Louis Gebrian

It is certified that error appears in the above-identified patent and that said Letters Patent is hereby corrected as shown below:

Column 8, Line 59: Delete "spring pin" and insert –pin spring--.

Signed and Sealed this

Twenty-ninth Day of June, 1999

*Attest:*

Q. TODD DICKINSON

*Attesting Officer*

*Acting Commissioner of Patents and Trademarks*